US009861995B2

(12) United States Patent
Lefevre et al.

(10) Patent No.: US 9,861,995 B2
(45) Date of Patent: Jan. 9, 2018

(54) DISPENSING DEVICE HAVING A RETRACTABLE HEAD

(71) Applicant: PARFUMS CHRISTIAN DIOR, Paris (FR)

(72) Inventors: Savine Lefevre, Compiegne (FR); Francois Gautier, Colombes (FR)

(73) Assignee: PARFUMS CHRISTIAN DIOR, Paris (FR)

( * ) Notice: Subject to any disclaimer, the term of this patent is extended or adjusted under 35 U.S.C. 154(b) by 13 days.

(21) Appl. No.: 15/111,974

(22) PCT Filed: Jan. 14, 2015

(86) PCT No.: PCT/FR2015/050080
§ 371 (c)(1),
(2) Date: Jul. 15, 2016

(87) PCT Pub. No.: WO2015/107294
PCT Pub. Date: Jul. 23, 2015

(65) Prior Publication Data

US 2016/0339465 A1 Nov. 24, 2016

(30) Foreign Application Priority Data

Jan. 16, 2014 (FR) ..... 14 50352

(51) Int. Cl.
*B05B 11/00* (2006.01)
*A45D 34/00* (2006.01)

(52) U.S. Cl.
CPC ..... *B05B 11/306* (2013.01); *A45D 34/00* (2013.01); *B05B 11/3035* (2013.01);
(Continued)

(58) Field of Classification Search
CPC ..... B05B 11/306; B05B 11/3035; B05B 11/3047; B05B 11/0032; A45D 34/00; A45D 2200/054
(Continued)

(56) References Cited

U.S. PATENT DOCUMENTS 5,499,747 A * 3/1996 Quennessen ..... A45D 40/06 132/320
2007/0246484 A1* 10/2007 Yoshida ..... B05B 11/3059 222/153.13
(Continued)

FOREIGN PATENT DOCUMENTS

WO 2008072833 6/2008

OTHER PUBLICATIONS

International Search Report and Written Opinion issued in International Application No. PCT/FR2015/050080 dated Apr. 15, 2015 (5 pages).

*Primary Examiner* — Paul R Durand
*Assistant Examiner* — Robert Nichols, II
(74) *Attorney, Agent, or Firm* — Hamre, Schumann, Mueller & Larson, P.C.

(57) ABSTRACT

A dispenser device for a container containing a product to be dispensed, the device comprising a body for connecting to the container and presenting a chamber that is open at a bottom end of the body and in which a pump is arranged, connected to a top dispenser head. The dispenser device also comprises a driver that is suitable for being moved so as to cause the dispenser head to move between a storage position in which the dispenser head is substantially retracted inside the body, and a dispensing position in which the dispenser head projects beyond a top end of the body. The dispenser device further comprises a sealing diaphragm that defines a top end of the chamber and that presents a movable end that
(Continued)

is connected to the pump, and a stationary end that is suitable for being connected to the container.

12 Claims, 5 Drawing Sheets

(52) U.S. Cl.
CPC .... *B05B 11/3047* (2013.01); *A45D 2200/054* (2013.01); *B05B 11/0032* (2013.01)

(58) Field of Classification Search
USPC ..... 222/182, 321.1, 167
See application file for complete search history.

(56) References Cited

U.S. PATENT DOCUMENTS

| | | | | |
|---|---|---|---|---|
| 2009/0120963 | A1 | 5/2009 | Bae | |
| 2011/0031282 | A1 | 2/2011 | Hagen | |
| 2012/0292344 | A1* | 11/2012 | Bertin | B05B 11/0032 222/153.13 |
| 2013/0140330 | A1* | 6/2013 | Christophe | A45D 34/02 222/153.13 |
| 2013/0200107 | A1* | 8/2013 | Presche | B05B 11/0032 222/153.13 |

* cited by examiner

DISPENSING DEVICE HAVING A RETRACTABLE HEAD

The present description relates to a dispenser device for a container containing a product to be dispensed, and more particularly to a dispenser device comprising a body for connecting to the container and presenting a chamber that is open at a bottom end of the body and in which a pump is arranged, connected to a top dispenser head, the dispenser device also comprising a driver that is suitable for being moved so as to cause the dispenser head to move between a storage position in which the dispenser head is substantially retracted inside the body, and a dispensing position in which the dispenser head projects beyond a top end of the body.

In the present description, the term "chamber" refers to the space in the body that is accessible to the fluid contained in the container. In particular, the chamber is not a pump chamber; on the contrary, as indicated above, the pump is arranged in the chamber.

The product to be dispensed may be any liquid or paste, in particular a sprayable product or a product under pressure. The product may be dispensed in the form of fine droplets or as a compact stream.

In the present description, the terms "top", "bottom", "high", and "low" should be understood in a relative sense only. They make it possible to distinguish two essentially-opposite locations, without prejudging the orientation of the device in three dimensional space. In particular, the straight line connecting a "high" point to a "low" point is not necessarily vertical in the usual sense of the term.

Dispenser devices of the above-mentioned type are known, e.g. from US patent application No. 2011/0031282. Movement of a driver makes it possible to deploy the dispenser head into a high position for use, or, on the contrary, to retract it into a low position for protecting it and preventing it from being actuated accidentally. Pivoting an outer ring moves the driver and the dispenser head in turning and in translation, via a cam movement, from the low position to the high position of the dispenser head.

In US application No. 2011/0031282, the dispenser head is secured to the driver to move therewith in turning and in translation. The driver and the dispenser head are pivotally mounted to turn about a tubular duct that forms one of the pump chambers of the device. In the dispensing position (high position), a top orifice of the tubular duct and a bottom orifice of a duct of the dispenser head are in alignment, such that the fluid can pass from the pump chamber to the dispenser head and leave via a nozzle of the dispenser head. Conversely, when the dispenser head is in its storage position (low position), the fluid cannot flow in so far as the two orifices are not in alignment and each is obstructed.

In that prior-art device, the fluid ducts are formed directly by movable parts such as the dispenser head or the parts that define the pump chamber. In use, the parts become worn and gaps may appear between them. By way of example, fluid might leak in the proximity of the orifices of the pump chamber and of the duct of the dispenser head. Furthermore, there are numerous connections between parts via which fluid might leak.

The invention seeks to propose a dispenser device that is simple and reliable, and that has a dispenser head that is retractable, while presenting an increased life span and little probability of the product to be dispensed leaking.

This object is achieved as a result of the dispenser device further comprising a sealing diaphragm that defines a top end of the chamber and that presents a movable end that is connected to the pump, and a stationary end that is suitable for being connected to the container.

It should be understood that the entire pump moves together with the movable end of the diaphragm, in particular when the dispenser head moves between a dispensing position and a storage position. The number of connections between the parts in contact with the fluid is thus limited: the container is connected to the diaphragm, the diaphragm to the pump, and the pump to the dispenser head. In this way, the possibility of the product contained in the container leaking is greatly reduced, and the diaphragm seals the dispenser device whatever the position of the dispenser head. By its nature, the sealing diaphragm seals the chamber, in particular at its ends. It may be designed to present particularly good resistance to wear, and thus to guarantee the long life span for the dispenser device even when used intensively.

Furthermore, such a dispenser device enables the dispenser head to be movable without it being necessary to fit the pump beforehand, since the pump can be moved by a completely distinct element of the pump. A conventional pump may thus be used, which is better in terms of reliability and cost.

Furthermore, the dispenser device is particularly generic and compatible with any container in so far as it suffices to design the stationary end of the sealing diaphragm so that the sealing diaphragm can be fastened to the opening of the intended container.

The connection between the pump and the dispenser head may be rigid. For example, the pump may carry the dispenser head by means of a rigid duct.

In addition, connection means may be provided between the pump and the driver so that said driver acts via the pump to drive the dispenser head that is connected to the pump.

In certain embodiments, the driver is configured to drive the movable end of the sealing diaphragm axially.

Thus, the driver drives the movable end of the sealing diaphragm that is connected to the pump axially, and thus drives the pump axially, which pump finally drives the dispenser head. The movable end of the sealing diaphragm thus forms a connection piece between the driver and the pump. The movable end, the driver, and the pump thus have the same axial drive movement, the drive axis being an axis that extends from the low position (storage position) of the dispenser head to the high position (dispensing position) of the dispenser head. By means of such a configuration, it is possible to limit any risk of the movable end remaining jammed and not following a joint movement of the pump and of the driver. Sealing the dispenser device in these embodiments is thus particularly reliable.

In certain embodiments, the movable end of the sealing diaphragm comprises a drive connection member for connecting it to the driver and the pump, and for driving them.

In such embodiments, the drive connection member connects together the movable end, the driver, and the pump. As a result, it transmits axial drive between the driver and the pump. The dispenser device is thus particularly simple.

In certain embodiments, the drive connection member comprises a connection piece that co-operates with axial shoulder-forming means of the driver.

The shoulders of the driver may hold the connection piece axially, while enabling the driver to pivot without causing said connection piece to turn, thus without causing the movable end to turn.

In certain embodiments, the drive connection member comprises a skirt on which the pump is fastened.

Thus, the skirt is the only portion of the diaphragm that must be adapted to the fastener system of the pump, so that the diaphragm is simple to design and manufacture. In these embodiments, the pump may, in particular, be fastened on the drive connection member outside the chamber.

In certain embodiments, the drive connection member presents an end wall that is configured in the shape of a dish for receiving the pump.

In these embodiments, the pump may be fastened on the drive connection member inside the chamber. The probability of fluid leaking out is thus reduced still further. The end wall of the drive connection member may be pierced so as to pass an outlet duct of the pump.

In various embodiments, the pump may be fastened to the drive connection member using various techniques. By way of example, it may be fastened by crimping or by clipping. In particular, a technique may be used that enables the pump and the drive connection member to be compressed one against the other, so as to reinforce the sealing of this connection.

In certain embodiments, the dispenser device comprises a stationary bushing that is situated inside the body, and the body comprises a ring-forming portion that is suitable for pivoting about a main axis, the bushing and the ring co-operating with the driver in such a manner that turning the ring causes the driver to shift in translation along the main axis.

The bushing, the driver, and the ring thus form a simple mechanism for transforming a turning movement performed by a user into a shift movement in translation. It should be understood that the main axis is both the turning axis and the axis of movement in translation, and that it also coincides with the above-mentioned drive axis.

In certain embodiments, the bushing and the driver co-operate via a cam mechanism.

In particular, in certain embodiments, one element selected from among the bushing and the driver includes sloping grooves, and the other element selected from among the bushing and the driver includes lugs that co-operate with said sloping grooves.

Thus, when the driver is driven in turning by a user via the ring, the lugs of one element selected from among the driver and the bushing follow the sloping grooves of the other element selected from among the driver and the bushing. Since the bushing is stationary relative to the body, this causes the driver to shift in axial translation in simple and reliable manner.

In certain embodiments, the driver and the ring co-operate via splines and grooves.

The co-operation between the splines and the grooves of the ring and the driver enables the ring and the driver to turn simultaneously. In particular, the grooves may be parallel to the turning axis of the ring, such that the driver can nevertheless remain free to move in axial translation relative to the ring.

In certain embodiments, the sealing diaphragm comprises a flexible portion between its movable end and its stationary end.

Thus, deformation of the flexible portion is substantially elastic and there is no friction zone on the flexible portion, which guarantees the long life span of the diaphragm. The diaphragm thus defines the top end of the chamber in completely leaktight manner whatever the position of the dispenser head.

In certain embodiments, the flexible portion is bellows-shaped.

In this way, the retracted position and the deployed position of the flexible portion are predetermined by the shape of the bellows. A bellows-shape is particularly good at withstanding wear due to repeated contractions and elongations. Furthermore, the various shapes of and the successive positions occupied by the diaphragm can be known with certainty, which facilitates designing the dispenser device as a whole.

In certain embodiments, the dispenser device comprises projecting and/or re-entrant catches (projections) for preventing it from moving relative to the container.

Thus, fastening the dispenser device on the container is both simple and reliable, and it prevents any relative movement in translation and/or in turning between the dispenser device and the container, except with regard to the ring. In particular, a pair of catches arranged on either side of an element makes it possible to prevent the element from shifting in translation in the direction between the catches; moreover, an additional pair of catches makes it possible to prevent said element from turning in the plane including the catches.

The invention and its advantages can be better understood on reading the following detailed description of embodiments of the invention given by way of non-limiting examples.

BRIEF DESCRIPTION OF THE DRAWINGS

FIGS. 1 and 2 show a first embodiment of the device dispenser 10 of the invention. The dispenser device 10 is for dispensing liquid or paste that is contained in a container 80. To do this, it comprises a body 20 and a dispenser head 30 that is removable and connected to a pump 50. The dispenser head may move between a high position and a low position by means of relative movements between a ring-forming portion 24 of the body 20, a driver 40, and a bushing 60. In the first embodiment, the ring 24 surrounds the driver 40 that is itself engaged on the bushing 60. In addition, a diaphragm 70 provides sealing between the container 80 and the pump 50, which is movable.

The high position and the low position of the dispenser head, respectively corresponding to the dispensing position and the storage position, are thus named with reference to the orientation shown in the figures, which is the orientation commonly used for such a dispenser device. Specifically, when a user holds a product bottle (container) in the hand in conventional manner, so as to exert pressure on the dispenser head with an index finger, an opening of the bottle fitted with a dispenser device faces upwards. In this configuration, the low position of the dispenser head corresponds to the position in which the head is closest to the bottle, in its storage position, and vice versa for the high position.

However, the position of the dispenser head could be changed, and the terms "high", "low", "top", "bottom", and associated terms should be considered in a relative sense only, and relative to any direction, and not necessarily a vertical direction.

Figure 1:
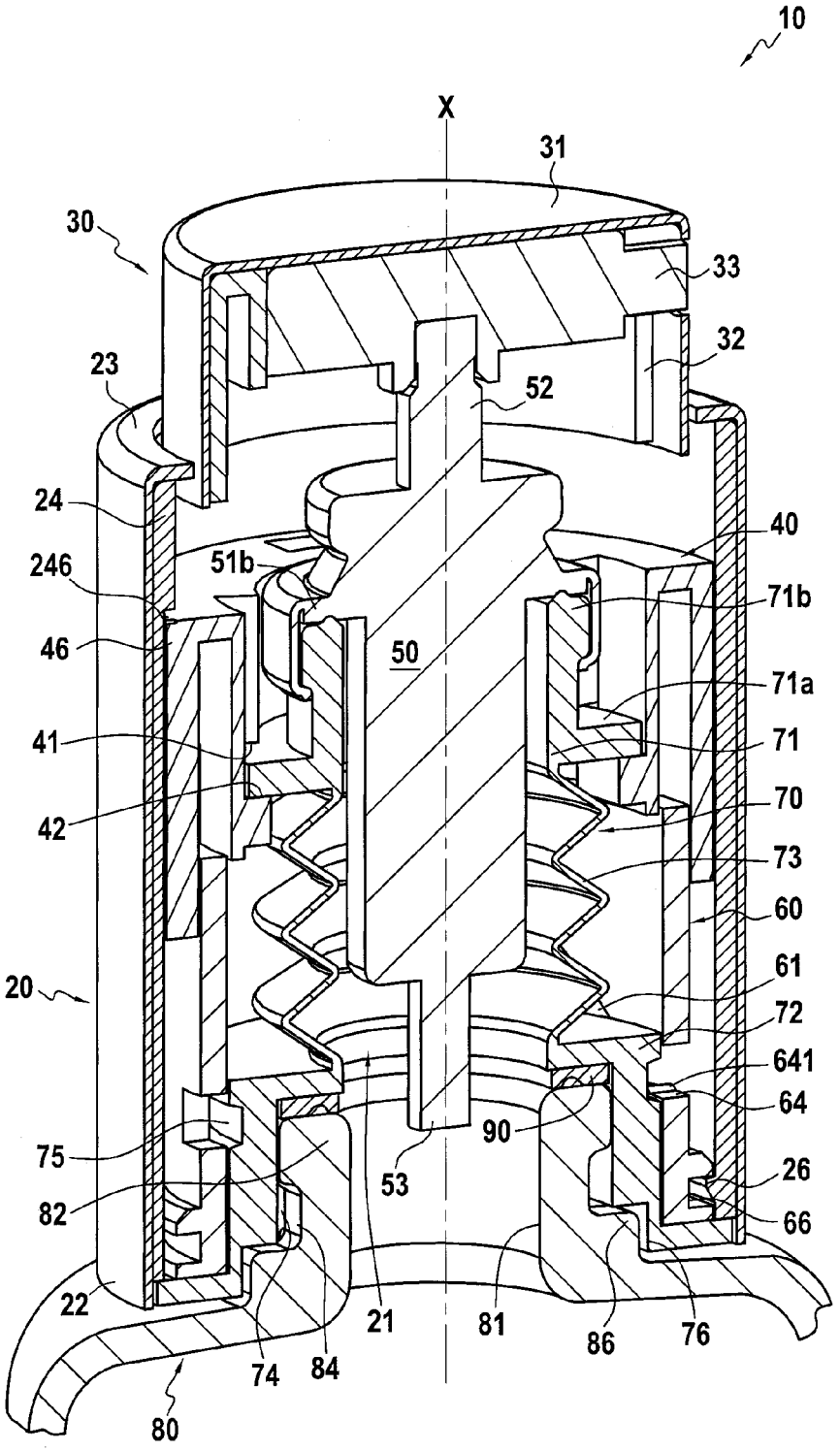
FIG. 1 is a longitudinal section view in perspective showing a first embodiment of the device mounted on a container, the dispenser head being in its high position (dispensing position)
Figure 3:
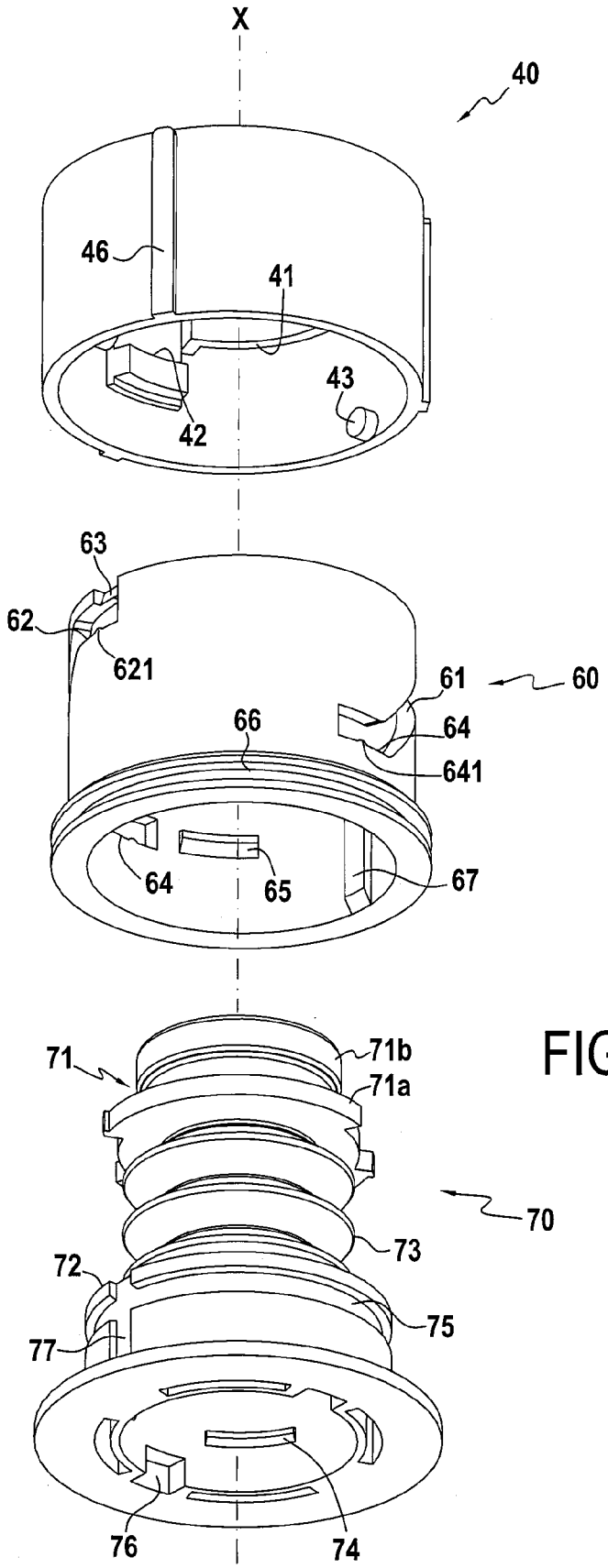
FIG. 3 is an exploded perspective view of the driver, of the bushing, and of the sealing diaphragm of the first embodiment of the device.
Figure 4:
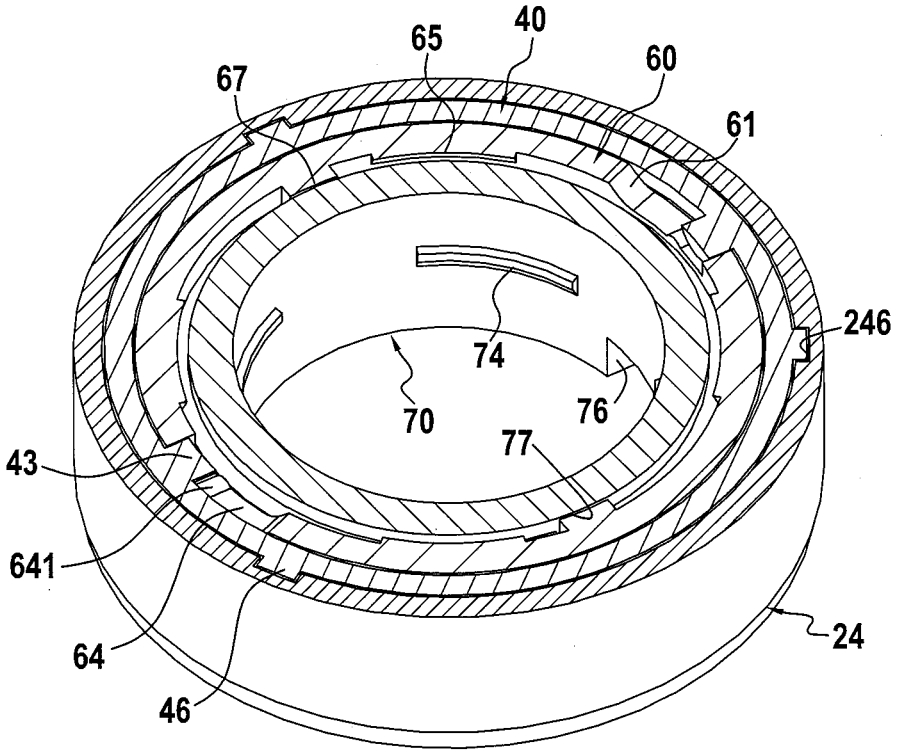
FIG. 4 is a perspective and cross-section view from above of the cam mechanism and of the diaphragm.

FIG. 3 is an exploded perspective view of the driver 40, the bushing 60, and the diaphragm 70, while FIG. 4 is a perspective and cross-section view showing co-operation between the ring 24, the driver 40, the bushing 60, and the diaphragm 70. FIG. 1 shows a portion only of the container 80, adjacent to its opening 81.

The body 20 is a cylinder of axis X and includes a chamber 21. A bottom end of the chamber 21 is open to the opening 81 of the container, while a top end of the chamber 21 is defined by the diaphragm 70. The diaphragm 70 comprises a movable end 71, a stationary end 72, and a flexible portion 73. The stationary end 72 is connected in leaktight manner to the opening 81 of the container. Optionally, and as shown in FIG. 1, a gasket 90 may be provided between the stationary end 72 of the diaphragm 70 and the edge of the neck 82 of the opening 81. Such a gasket makes it possible to improve the sealing of the device.

By way of example, the diaphragm 70 may be made of flexible material such as polyethylene or polypropylene. It is thus possible to make provision for the stationary end 72 to be compressed a little around the opening 81, so that sealing between the container 8 and the chamber 21 is excellent.

In order to avoid the stationary end 72 of the diaphragm 70 becoming detached from the opening 81 of the container, holding catches 74 are provided that project from an inside surface of the stationary end 72. The holding catches 74 co-operate with a groove 84 that is provided close to the opening 81 of the container 80, typically at the edge of the neck 82. As shown in FIG. 3, in which the sealing diaphragm 70 is seen from below and in perspective, the holding catches 74 have a beveled shape, thereby making it possible to engage them easily in the groove 84, without them becoming disengaged therefrom by themselves.

Furthermore, at the periphery of the opening 81, the container 80 includes projecting catches 86 that co-operate with corresponding re-entrant catches (housings) 76 of the stationary end 72. The shape of the housings 76 of the bottom end 72 can also be seen in FIGS. 3 and 4. The catches 86 are blocked tangentially by the housings 76, and this prevents the stationary end 72 from turning relative to the container 80. Thus, the combination of the catches 74 and 86 and of their respective housings 84, 76 ensures that the stationary end 72 cannot be moved relative to the opening 81 in any direction in translation or in turning.

The stationary end 72 is connected to the movable end 71 of the diaphragm 70 via the flexible portion 73 that, in this embodiment, presents a bellows-shape (also known as an accordion shape). The flexible portion is shown stretched out in FIG. 1. The movable end 71 and the flexible portion 73 define the chamber 21 having an internal volume that is accessible to the product contained in the container 80.

The movable end 71 includes a skirt 71*b* on which the pump 50 is fastened. In the example of the first embodiment, the pump is crimped on the skirt 71*b*. Thus, the pump 50 is situated inside the chamber 21, and the crimping zone 51*b* is situated outside the chamber 21. During crimping, the crimping zone 51*b* may be compressed against the skirt 71*b* so as to reinforce sealing of this connection. This embodiment of the invention presents the advantage of being able to use existing pumps that are provided with a crimping zone, also referred to as a collar, since the fastening method is similar to the fastening method of a conventional container on which the pump is fastened by pressing the crimping zone directly onto the opening of the container.

Figure 2:
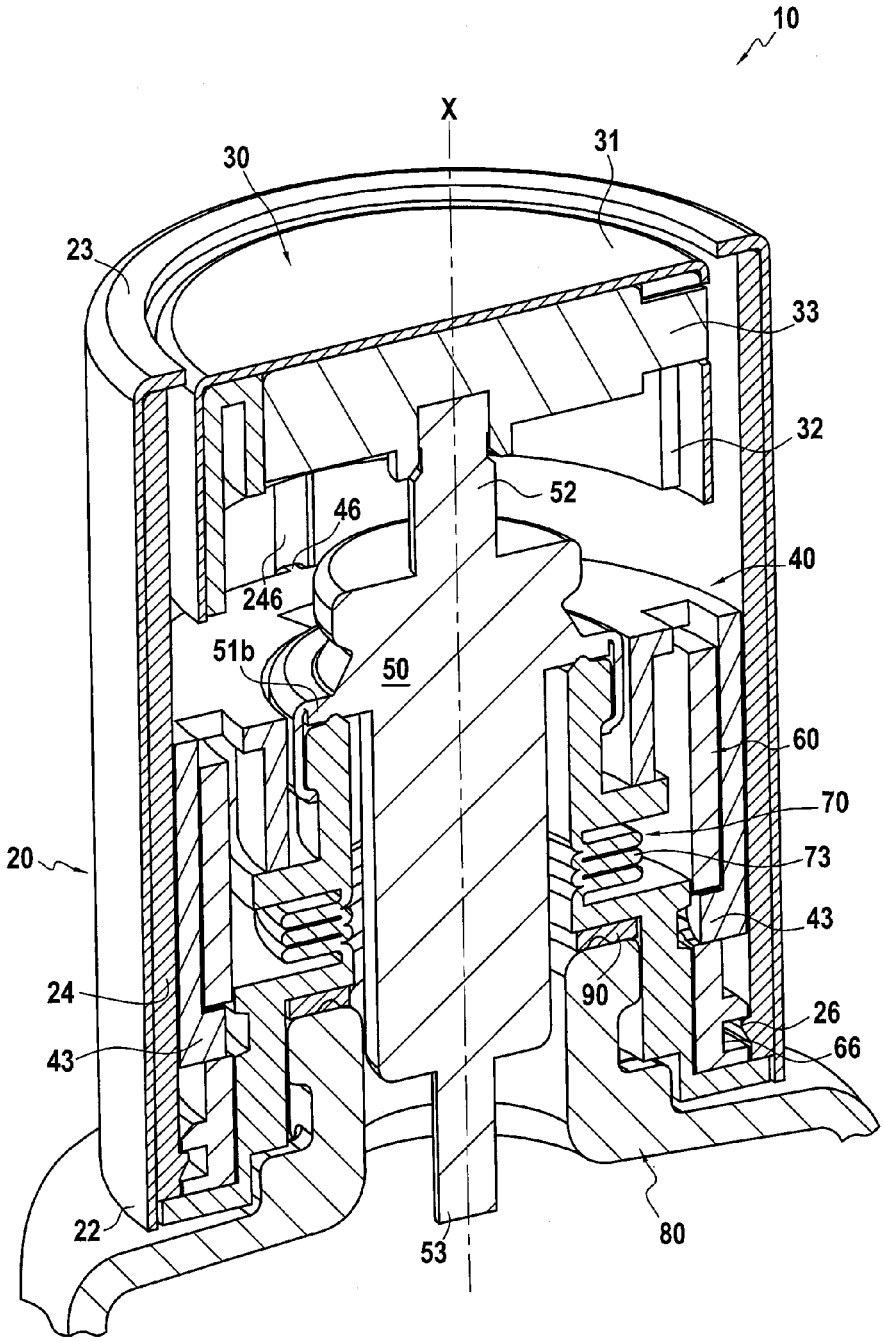
FIG. 2 is a longitudinal section view in perspective of the first embodiment of the device, the dispenser head being in its low position (storage position)
Figure 5:
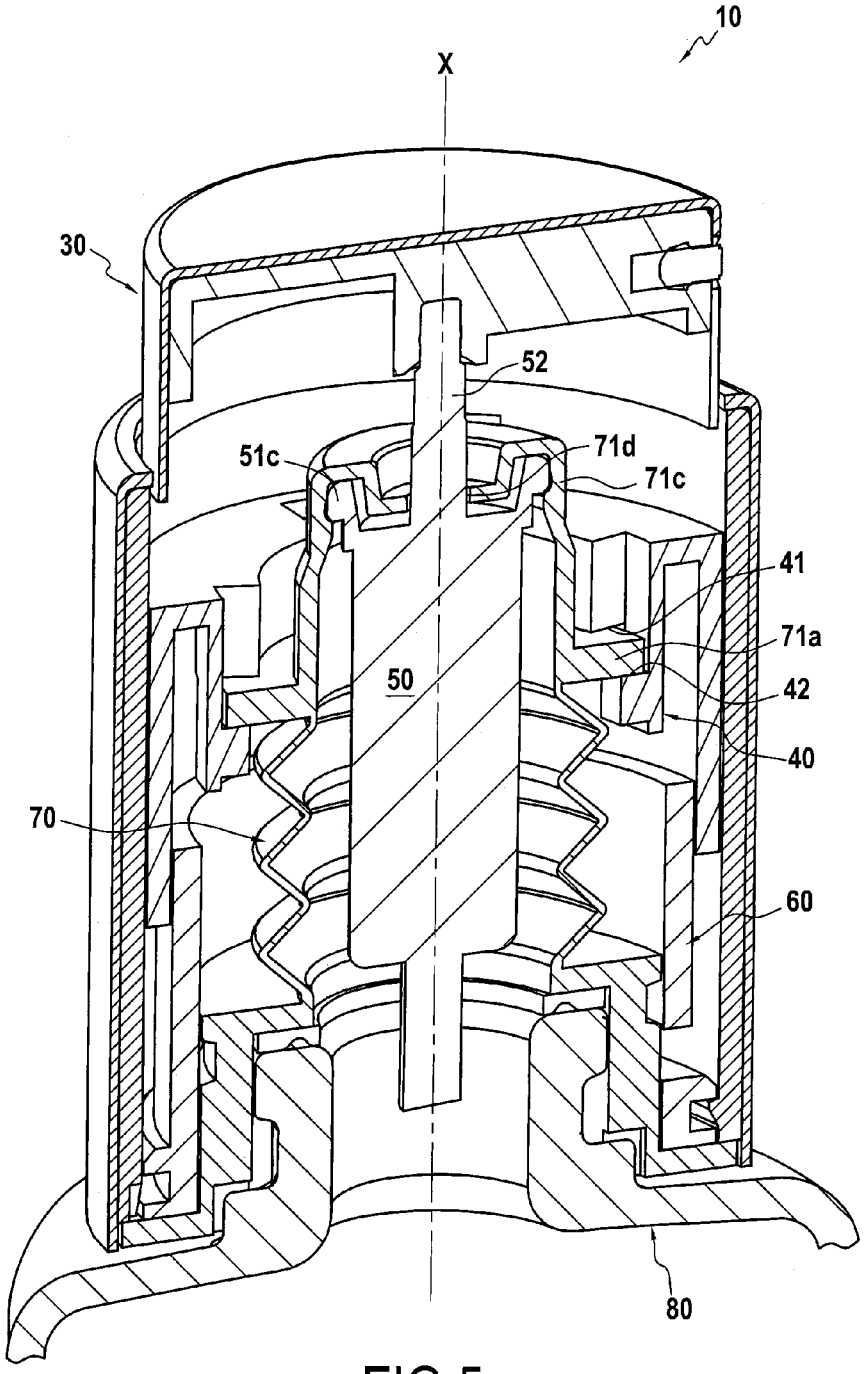
FIG. 5 is a longitudinal section view in perspective of a second embodiment of the device, the dispenser head being in its high position.

In FIGS. 1, 2, and 5, the pump 50 is represented diagrammatically. Only its external structure is shown, which is useful in understanding the invention.

In addition, the pump 50 comprises a duct 53 (shown in part) that is rigid or flexible, and that is for taking fluid from the container 80. The internal structure of the pump is known to the person skilled in the art and is not described in detail in the present description. The chamber 21 is not a pump chamber, the pump 50 being an entirely separate pump that is independent from the diaphragm 70 and from its flexible portion 73.

The pump 50 is connected to the dispenser head 30 via an outlet duct 52 that, in particular, is a duct that is rigid enough for the dispenser head 30 to follow the movements of the pump 50 along the axis X. The dispenser head 30 is of conventional structure. Specifically, it comprises an outer cover 31, a pusher 32, and a dispenser member 33. The movable end 71, the pump 50, and the dispenser head 30 move together at least in translation along the axis X, except when the user presses on the dispenser head 30 in order to deliver product.

The driver 40 makes it possible to drive the pump 50 and the dispenser head 30 between a low position in which the dispenser head 30 is substantially retracted inside the body 20, and a high position in which the dispenser head 30 projects beyond a top end 23 of the body 20. The driver 40 is capable of moving by means of a cam mechanism, and is capable of driving the movable end 71, the pump 50, and the dispenser head 30 in translation along the axis X. For this purpose, the driver 40 includes shoulders 41, 42 that co-operate with a connection piece 71*a* of the movable end. The connection piece 71*a* is clamped axially between the top shoulder 41 and the bottom shoulder 42. The top shoulder 41 makes it possible to push the connection piece 71*a* towards the bottom of the body 20, while the bottom shoulder 42 makes it possible to push the connection piece 71*a* towards the top of the body 20. In particular, the shoulders 41, 42 do not impede turning the driver 40 relative to the movable end 71, about the axis X. The shoulders 41, 42 of the driver 40 can also be seen in FIG. 3. The connection piece 71*a* and the skirt 71*b* thus form a drive connection member for shifting the connection piece of the movable end 71 together with the driver 40 and the pump 50 along the axis X.

The cam mechanism that makes it possible to shift the driver along the axis X is described below with reference to FIGS. 1 to 4. As indicated above, the dispenser device 10 comprises the stationary bushing 60 that is situated inside the body 20, and the body 20 comprises the ring-forming portion 24. The driver 40 and the bushing 60 are shown in exploded perspective view in FIG. 3. The ring-forming portion 24, the driver 40, and the bushing 60 may, independently of one another, be made of a rigid material, and in particular of polyacetal.

In the example embodiment shown in FIGS. 1 and 2, the ring 24 has the same height as the body 20, measured along axis X; the ring 24 could have a height that is different from the height of the body X. Furthermore, the ring 24 is hidden by a cylindrical cover 22, which is also optional. The ring 24 can be turned about the axis X. As shown in FIG. 4, it includes internal grooves 246 that are parallel to the axis X and that are configured to co-operate with corresponding splines 46 of the driver 40. The ring 24 and the driver 40 are thus constrained to turn together about the axis X. Any turning of the ring 24 about the axis X thus moves the driver 40 with the same turning movement.

The bushing 60 is fastened and stationary relative to the stationary end 72 of the diaphragm 70. As can be seen in FIG. 3, this is achieved by the stationary end 72 including an annular groove 75 and axial grooves 77. The grooves receive and block corresponding catches provided inside the bushing, namely anti-shift catches 65 and anti-turning catches 67. The anti-shift catches 65 could be annular ribs.

Similarly, in order to prevent the ring 24 from shifting in translation, while enabling it to move in turning about the axis X, the bushing 60 includes an external annular groove 66 in which turning catches 26 come to be engaged, which turning catches are provided on an inside surface of the ring 24. As can be seen in FIG. 1, the rib adjacent to the external annular groove 66 and each of the turning catches 26 have respective portions that are beveled in the axial direction, so as to make them easier to engage and so as to prevent them from becoming separated.

As shown in FIGS. 3 and 4, the bushing 60 includes two sloping grooves 61 on its outer periphery. Specifically, the sloping grooves 61 are in the shape of helical cutouts, each including, at its ends, a flat top 62 and a flat bottom 64. On its inside surface, the driver 40 includes lugs 43 that co-operate with the sloping grooves 61. In particular, the driver 40 includes as many lugs 43 as the bushing includes sloping grooves 61, i.e. two lugs 43 in this embodiment. Each lug 43 is movable in a groove 61.

The flats 62, 64 correspond to stable positions of a lug 43 relative to the sloping groove 61. They include respective blocking bumps 621, 641 that project a little relative to the bottom surface of each flat. When a lug 43 reaches a flat, e.g. the bottom flat 64, it can follow its stroke until it passes over the blocking bump 641. After passing over the bump, its position in the bottom flat 64 is firmly held by the blocking bump 641, and additional force must be exerted to enable the lug 43 to leave the bottom flat 64. Consequently, the device is caused to be stable in the stable positions corresponding to the bottom flat 64. The top flat 62 and its blocking bump 621 operate in the same manner. The bumps 621, 641 thus form hard points that ensure the driver is stable in its extreme positions.

At the top of each top flat 62, the bushing 60 further includes a respective notch 63, making it easy to insert the lugs of the driver 40 into the sloping grooves 61 while the dispenser device 10 is being assembled.

Since the bushing 60 is stationary relative to the container 80, moving the lugs 43 in the sloping grooves 61 makes it possible to associate a movement in turning of the driver 40, with a movement in translation along the axis X, and vice versa. Specifically, the sloping arrangement of the sloping grooves 61 forces a lug 43 to turn about the axis X when it moves axially along the axis X, and vice versa forces a lug 43 to move axially when it is turned about the axis X. It is precisely in this way that the dispenser device shown in FIG. 1 operates, e.g. while the dispenser head 30 is passing from its high position to its low position. This operation is described below in detail.

The initial state (in the dispensing position) is the state shown in FIG. 1: the dispenser head 30 projects a little beyond a top end 23 of the body 20, the lugs 43 are situated in the top flats 62, and the flexible portion 73 of the diaphragm 70 is extended. In order to move the dispenser head towards the low position (storage position), a user causes the ring 24 to turn in the clockwise direction (as seen from above). The ring 24 turns the driver 40 as a result of the grooves 246 co-operating with the splines 46. The driver 40 thus turns in the clockwise direction. The lugs 43 of the driver 40 thus turn in the sloping grooves 61 in the clockwise direction, i.e. they leave the top flats 62 and follow the sloping grooves 61 downwards. This thus causes the driver 40 to move downwards in translation along the axis X. The movement continues until the lugs 43 reach the low flats 64 and pass over the blocking bumps 641. In addition, during the movement of the driver along the axis X, the shoulders 41 guide the connection piece 71*a* downwards. As indicated above, although the driver 40 pivots about the axis X, the shoulders 42 are provided so that the connection piece 71*a* does not pivot. The connection piece moves the entire movable end 71 downwards, which also moves the pump 50 and the dispenser head 30 downwards, without causing them to pivot. The flexible portion 73 of the diaphragm 70 folds up. The final state (in the storage position) is shown in FIG. 2.

In FIG. 2, it can be seen that the lugs 43 are housed in the low flats 62 behind the blocking bumps 621, the bellows of the flexible portion 73 are folded up, and the dispenser head 30 is retracted inside the body and does not project beyond the top end 23.

The dispenser head 30 passes from the storage position shown in FIG. 2 to the dispensing position shown in FIG. 1 in the same way, but with all of the directions being reversed.

FIG. 5 shows a second embodiment of the dispenser device. In this figure, the elements that correspond or that are identical to elements in the first embodiment are given the same reference signs and they are not described again.

The second embodiment differs from the first essentially in the fastener structure for fastening the pump 50 to the movable end 71 of the diaphragm 70. In this embodiment, the movable end 71 still comprises a connection piece 71*a* for co-operating with shoulders 41, 42 of the driver. Instead of the skirt 71*b*, the movable end 71 includes a dish-shaped end wall 71*c* for receiving the pump 50. Specifically, the pump 50 is provided with a projecting portion 51*c* that is complementary to the end wall 71*c* and that is suitable for being clipped on the end wall 71*c*. In the embodiment shown, the end wall 71*c* and the projecting portion 51*c* are circularly symmetrical about the axis X. Furthermore, the end wall 71*c* is pierced by a hole 71*d* for passing the outlet duct 52 of the pump 50 towards the dispenser head. In contrast to the first embodiment, this second embodiment requires a non-standard pump 50 to be used since it is necessary to assemble a sealing diaphragm, including the crimping zone, onto a pump body designed for this purpose, with this being done prior to any fastening of the device on the container.

Although the present invention is described with reference to specific embodiments, modifications and changes may naturally be applied to them without going beyond the general ambit of the invention as defined by the claims. In particular, individual characteristics of the various embodiments shown and mentioned may be combined in additional embodiments. Consequently, the description and the drawings should be considered in a sense that is illustrative rather than restrictive.

The invention claimed is:

1. A dispenser device for a container containing a product to be dispensed, the device comprising a body for connecting to the container and presenting a chamber that is open at a bottom end of the body and in which a pump is arranged, connected to a dispenser head, the dispenser device also comprising a driver that is suitable for being moved so as to cause the dispenser head to move between a storage position in which the dispenser head is substantially retracted inside the body, and a dispensing position in which the dispenser head projects beyond a top end of the body, the dispenser device further comprises a sealing diaphragm that defines a top end of the chamber and that presents a movable end that is connected to the pump, whereby the pump moves together with the movable end, and a stationary end that is suitable for being connected to the container.

2. A dispenser device according to claim 1, wherein the driver is configured to drive the movable end of the sealing diaphragm axially.

3. A dispenser device according to claim 2, wherein the movable end of the sealing diaphragm comprises a drive connection member for connecting the sealing diaphragm to the driver and the pump.

4. A dispenser device according to claim 3, wherein the drive connection member comprises a connection piece that co-operates with an axial shoulder-forming means of the driver.

5. A dispenser device according to claim 3, wherein the drive connection member comprises a skirt on which the pump is fastened.

6. A dispenser device according to claim 3, wherein the drive connection member presents an end wall that is configured in the shape of a dish for receiving the pump.

7. A dispenser device according to claim 1, comprising a stationary bushing that is situated inside the body, and wherein the body comprises a ring-forming portion that is suitable for pivoting about a main axis, the bushing and the ring co-operating with the driver in such a manner that turning the ring causes the driver to shift in translation along the main axis.

8. A dispenser device according to claim 7, wherein the bushing and the driver co-operate via a cam mechanism.

9. A dispenser device according to claim 7, wherein the driver and the ring co-operate via splines and grooves.

10. A dispenser device according to claim 1, wherein the sealing diaphragm comprising a flexible portion between its movable end and its stationary end.

11. A dispenser device according to claim 10, wherein the flexible portion is bellows-shaped.

12. A dispenser device (10) according to claim 1, comprising projecting and/or re-entrant catches for preventing it from moving relative to the container.

* * * * *